US012416479B2

(12) United States Patent
Muller et al.

(10) Patent No.: US 12,416,479 B2
(45) Date of Patent: Sep. 16, 2025

(54) APPARATUS FOR USE IN A WIRELESS DETONATOR SYSTEM

(71) Applicant: DETNET SOUTH AFRICA (PTY) LTD, Johannesburg (ZA)

(72) Inventors: Elmar Lennox Muller, Centurion (ZA); Abraham Johannes Liebenberg, Johannesburg (ZA); Tielman Christian Meyer, Johannesburg (ZA); Marius Christo Botha, Johannesburg (ZA); Ruan Smith, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 196 days.

(21) Appl. No.: 18/546,754

(22) PCT Filed: Mar. 10, 2022

(86) PCT No.: PCT/ZA2022/050012
§ 371 (c)(1),
(2) Date: Aug. 16, 2023

(87) PCT Pub. No.: WO2022/246481
PCT Pub. Date: Nov. 24, 2022

(65) Prior Publication Data

US 2024/0310156 A1 Sep. 19, 2024

(30) Foreign Application Priority Data

May 20, 2021 (ZA) ..... 2021/03409

(51) Int. Cl.
*F42D 1/05* (2006.01)

(52) U.S. Cl.
CPC ..... *F42D 1/05* (2013.01)

(58) Field of Classification Search
CPC ..... F42D 1/05; F42D 1/055; F42C 15/42
USPC ..... 361/247
See application file for complete search history.

(56) References Cited

U.S. PATENT DOCUMENTS 7,347,379 B2 3/2008 Ward et al.
2008/0307993 A1* 12/2008 Chan ..... F42B 3/113 102/214
2015/0177305 A1* 6/2015 Janarthanam ..... G01R 31/006 324/503

FOREIGN PATENT DOCUMENTS

WO WO-2012061850 A1 * 5/2012 ..... F42C 15/42

OTHER PUBLICATIONS

International Search Report and Written Opinion for Application No. PCT/ZA2022/050012 dated for Apr. 7, 2022 (9 pages).

* cited by examiner

*Primary Examiner* — Yemane Mehari
(74) *Attorney, Agent, or Firm* — Michael Best & Friedrich LLP

(57) ABSTRACT

Apparatus, for use in a wireless detonator system, which includes a portable housing, a bank of capacitors in the housing, first terminals for connection to selected capacitors to an antenna in the system, second terminals for connection to a transmitter, and a measurement and output arrangement which provides signals which indicate the integrity of such connections.

7 Claims, 3 Drawing Sheets

APPARATUS FOR USE IN A WIRELESS DETONATOR SYSTEM

CROSS REFERENCE TO RELATED APPLICATIONS

This application is a U.S. National Phase application of International Application No. PCT/ZA2022/050012, filed Mar. 10, 2022, which claims priority to South African Patent Application No. 2021/03409, filed May 20, 2021, the entire contents of both of which are herein incorporated by reference.

BACKGROUND OF THE INVENTION

This invention relates generally to a wireless detonator system but more particularly to the connection of a transmitter to an antenna which is used for communicating wirelessly with detonators.

In an arrangement of the aforementioned kind an antenna, which normally comprises a large loop, is connected to a bank of capacitors which provides a high voltage for driving the antenna. The capacitor bank, in turn, is connected to a transmitter the operation of which is effected via a blast control unit.

For operational reasons the transmitter and the capacitor bank are spaced apart by a substantial distance, typically 100 metres, but this distance can be increased meaningfully depending on other factors.

The spacing between the capacitor bank and the antenna, by way of contrast, is relatively small typically no more than 5 metres.

It is important for reliability of operation to ensure that sound and effective connections are made between the transmitter and the capacitor bank on the one hand and between the capacitor bank and the antenna on the other hand. To monitor this aspect the transmitter includes or is associated with a circuit which can indicate the integrity of the various connections.

In practice an operator connects the capacitor bank firstly to the antenna and thereafter to the transmitter. The operator then walks to the transmitter and carries out a testing sequence to obtain an indication of the integrity of the connections. If the connections are not satisfactory the operator must return to the capacitor bank and remedy the situation.

Another aspect which must be considered is that the capacitor bank should be capable of working with antennas of different sizes which, inherently, have different values of inductance. To achieve a tuned circuit the capacitance value should be adjustable to meet the capacitance value for a particular antenna.

An object of the present invention is to address the aforementioned aspects including, in particular, the requirement for the operator to move between the capacitor bank and the transmitter in order to verify the integrity of the connections which are made to the capacitor bank.

SUMMARY OF THE INVENTION

The invention provides apparatus for use in a wireless detonator system, the apparatus including a housing and, mounted in or to the housing, a bank of capacitors, antenna terminals on the capacitors for connection to an antenna, input terminals for connection at least to a transmitter arrangement, a charging circuit for charging the capacitors, a measurement circuit configured to measure the integrity of connections of the antenna made to the antenna terminals and to measure the integrity of connections of the transmitter arrangement made to the input terminals, and an output device, responsive to the measurement circuit, to provide one or more output signals which are dependent on the integrity measurements.

The apparatus, in practice, may be required to be connected to an antenna selected from two or more antennas. Different antenna configurations have different transmission ranges. To facilitate use of the apparatus with different antenna configurations the antennas are designed to have substantially the same inductance. This characteristic allows each antenna, which is selected, to be used with the same bank of capacitors.

Alternatively or additionally the measurement circuit is adapted to measure the inductance of any particular antenna connected to the apparatus. The capacitor bank may comprise a plurality of capacitors of different values, or modules of capacitors with different values. A processor, suitably programmed, can calculate the value of capacitors to be connected to the antenna to achieve optimum performance. Thereafter one or two approaches may be adopted. Firstly an operator may, using data output via a display manually ensure that the correct capacitors are connected to the antenna. Alternatively the processor, working through the medium of a custom-designed switching circuit, may automatically function to ensure that the correct capacitors are connected to the inductance.

Another possibility is that for a given antenna the switching circuit may sweep through a range of capacitor values connecting different configurations of capacitors, in turn, to the inductors and, after each connection is made, ensure that a test signal is injected into the inductor and capacitor array. In this way, from practical observations, the correct value of capacitors connected to the antenna may be assessed for optimum performance.

The apparatus preferably includes an onboard power source for powering, at least, the output device. Preferably the output signal produced by the output device provides a visual display which is dependent on the integrity measurements. The output signal may be output via a display, by means of one or more light sources e.g. light-emitting diodes or the like, or by a communication link to a device that facilitates automatic tuning of inductance and capacitance. Light sources of different colours may be used to indicate connections of an acceptable quality and connections which are unacceptable.

The display may, according to requirement, display a measured capacitance value, or the capacitance values of capacitors which are chosen to be connected to the antenna.

Another possibility is that the measurement circuit can be employed to measure the resistance of the antenna. If the resistance of the antenna coil is known from predetermined measurements then, depending on where the resistance measurements are made, any significant variation from the known resistance value would be indicative of poor connections to the antenna, possible antenna damage, temperature or humidity or moisture effects, or the like.

The power source may comprise a battery which is recharged by electrical energy drawn from energy supplied by the transmitter arrangement through a cable which is connected to the input terminals.

The cable which is connected to the input terminals may, in one embodiment of the invention, be used to supply the charging circuit which is used for charging the capacitors. Another possibility is to connect a main supply cable to the apparatus to charge the capacitors—this approach is possible for a more permanent installation.

The apparatus may alternatively or additionally include a battery which is charged, as appropriate, to power the capacitors and to operate the circuits embodied in the apparatus.

The integrity of the connections to the antenna may be measured or assessed in any appropriate way. Conveniently a measurement is made of the inductance and capacitance of the antenna for these are known quantities established by design parameters. These measurements can be made automatically as required, by means of custom designed devices which automatically are connected as required to appropriate contacts provided for the propose in the apparatus. The values of readings then taken are sent to a controller for storage or assessment purposes. The connections which were made are then automatically interrupted. As indicated resistance measurements of the antenna may also be assessed to obtain an indication of the integrity of the connections. Meaningful deviations from known antenna resistance values are possible indicators of poor connections. Thus any measuring instrument or instruments or method suitable for making inductance, capacitive and resistance measurements in an automated way can be employed in the apparatus.

The apparatus may include a memory unit in which details of measurements made by the measuring circuit are stored. Data from the memory unit can be retrieved using any appropriate device and for example the apparatus may include a near field communication facility or be accessible via a Wi-fi connection or through the medium of a USB port or the like. The invention is not limited in that regard.

The processor referred to may enable intelligent control of functions of the apparatus to be effected.

The provision of a power source, in the apparatus, which is independent of the energy stored in the capacitor bank, and the incorporation of a processor, enable the functionality of the apparatus to be enhanced. The power source may be powered by means of rechargeable batteries which are recharged from time to time as necessary. Another possibility is to have a separate power supply, e.g. from a mains source, to the apparatus. In this respect it falls within the scope of the invention for one or more sensors to be connected to the apparatus and for data produced by the sensors to be stored in the memory unit. The sensors may be used to measure or monitor one or more of at least the following parameters: temperature, humidity, time of operation, the geographical position of the apparatus, and any other factor which may be variable and which could possibly have an influence on a blasting process.

The transmitter arrangement may include a transmitter which is responsive to instructions from a blast control unit. Signals from the blast control unit are applied via the apparatus to the antenna which is driven at a high voltage using energy from the capacitor bank, to achieve a suitable transmission range. Energy for operation of the apparatus may be supplied, as indicated, via a cable linking the transmitter to the input terminals.

The housing may include a base in or to which the capacitor bank, the charging circuit, the measurement circuit, the memory unit, the processor and the output device are mounted, with the output device being visible on an outer surface of the base. The antenna terminals and the input terminals may be on the outer surface. The housing may include a closure which is mounted to the base and which is movable to overlie the terminals and the output device thereby to provide protection for these components and safety for personnel.

The invention also extends to a method of establishing a wireless detonator blasting system which includes the steps of deploying detonators at a blast site, surrounding the blast site with a loop antenna, measuring the resistance, inductance and capacitance of the antenna, comparing the measured resistance, inductance and capacitance values to known values stored in a memory thereby to obtain an assessment of the integrity of connections made to the antenna, using a switching circuit to connect sets of capacitors, of different capacitance values, automatically in succession to the loop antenna and, for each set of capacitors connected to the loop antenna, obtaining a measurement of the degree of inductive/capacitive tuning of the antenna, in response to each measurement selecting a set of capacitors for operative connection to the loop antenna, measuring the integrity of all connections to the loop antenna and, if the connections are acceptable, charging the capacitors to an operating voltage to commence a blasting process.

BRIEF DESCRIPTION OF THE DRAWINGS

The invention is further described by way of example with reference to the accompanying drawings in which.

DESCRIPTION OF PREFERRED EMBODIMENT

Figure 1:
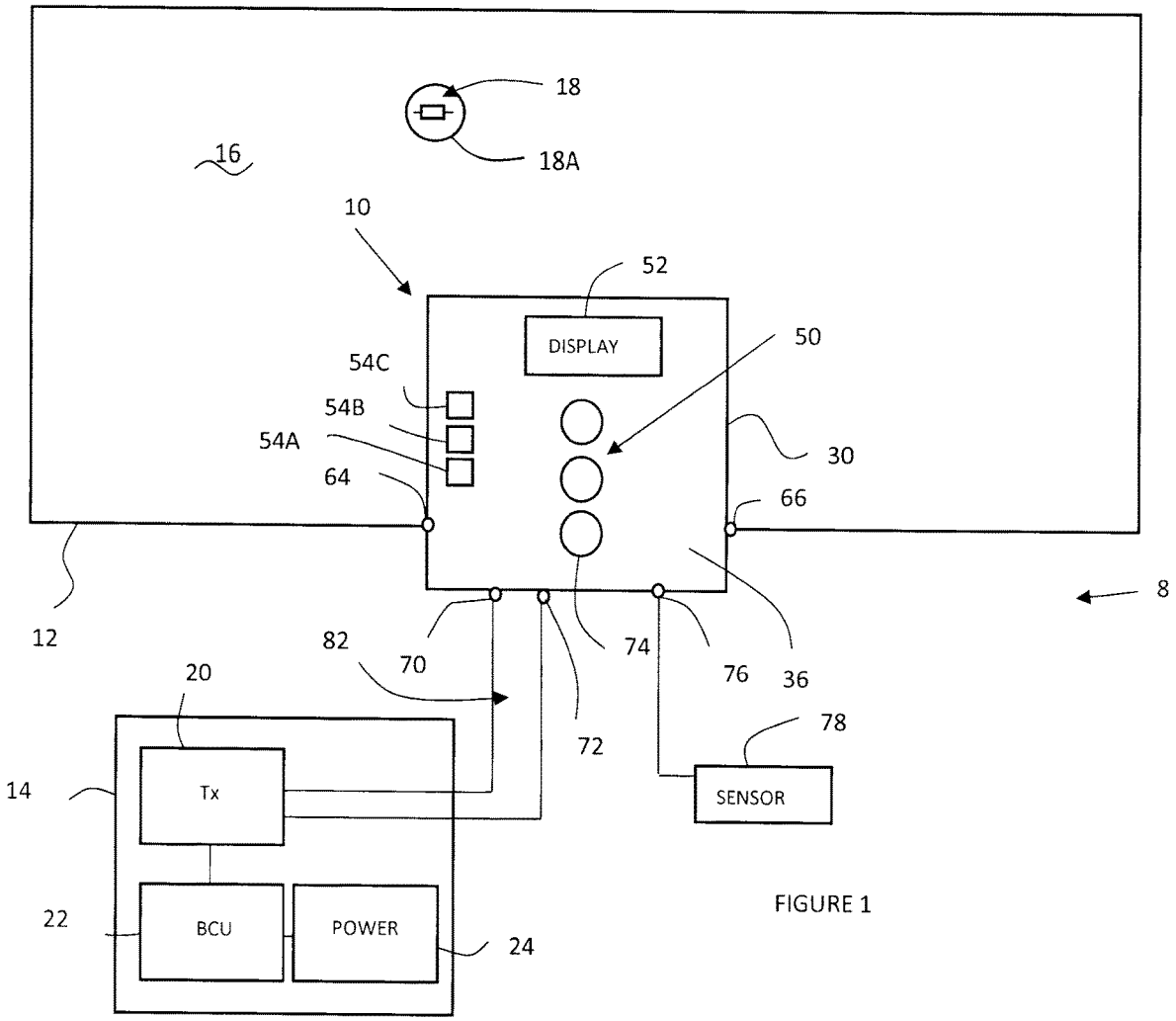
FIG. 1 is a schematic depiction of a wireless detonator system which includes apparatus according to the invention.

FIG. 1 of the accompanying drawings illustrates a part of a wireless detonator blasting system which includes apparatus 10 according to the invention which is connected to a loop antenna 12 at a blast site and to a transmitter arrangement 14. The blasting system may be implemented on surface, or at an underground location.

The loop antenna 12, which may comprise multiple turns, typically encloses a blast site of a large area 16 in which detonators 18 (only one detonator is shown), which are wirelessly operable, are placed in boreholes 18A drilled in the ground (only one boreholes is shown). The manner in which the boreholes are drilled and in which the detonators are deployed is known in the art and is not further described herein. The detonators are designed so that, for example in a unidirectional system, instructions and data from the transmitter arrangement 14 can be sent to the various detonators. In a bidirectional system information can be sent in the reverse direction i.e. from the detonators to the transmitter arrangement which would then include an appropriate receiver. These aspects are known in the art and for this reason are not further described herein.

The transmitter arrangement 14 includes a transmitter 20 and a blast control unit 22 which controls the operation of the transmitter. The transmitter arrangement also includes a power source 24.

The antenna 12 is designed according to operational requirements. The apparatus 10 is usable with a range of different antennas and to facilitate this aspect the antennas are, where possible, designed to have the same inductances. This allows antennas of different sizes to be used with the same apparatus 10. The size of the antenna is chosen according to the desired range of signal transmission.

Figure 3:
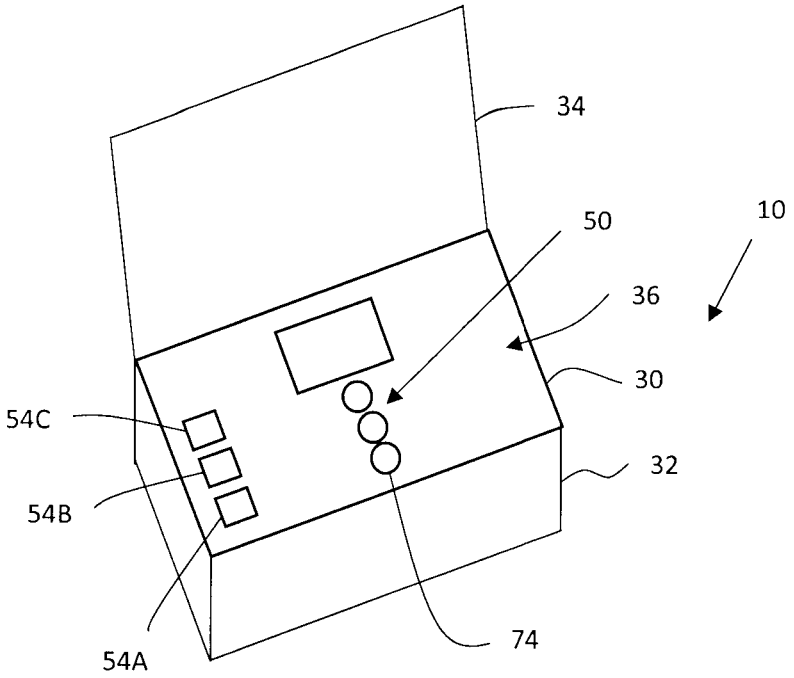
FIG. 3 is a perspective illustration of a physical embodiment of the apparatus of the invention.

The apparatus 10, which is portable, includes a housing 30, see FIG. 3, which consists of a base 32 and a closure 34 which is pivotally mounted to the base. Components of the apparatus which must be easily accessed during use of the apparatus 10 and which facilitate operation of the apparatus are mounted on a surface 36 of the base. Details of these components are described hereinafter. When the closure 34 is moved to a closed position it overlies the various components on the surface 36 and thereby provides a degree of physical protection for these components and safety for operating personnel.

Figure 2:
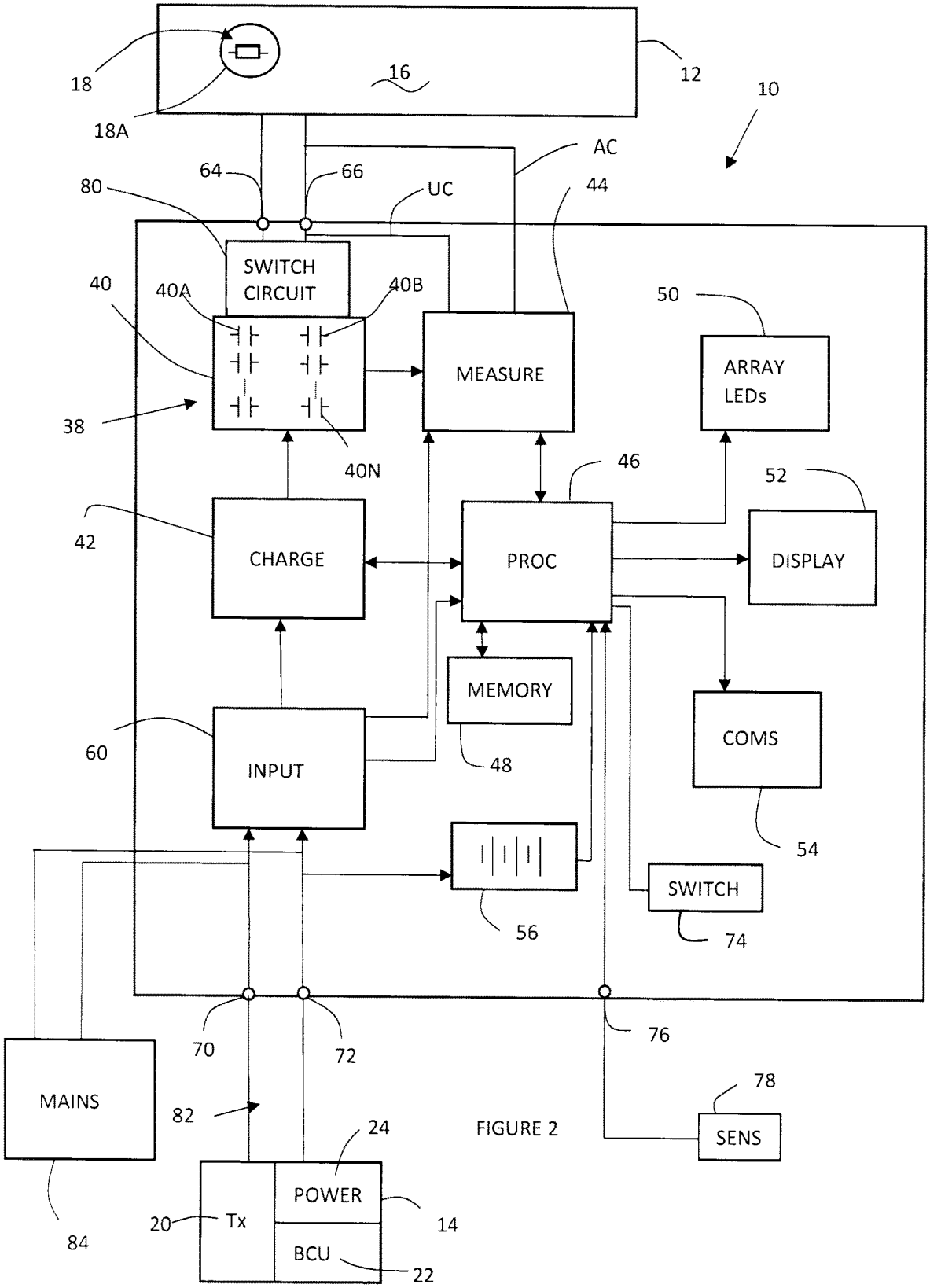
FIG. 2 depicts in block diagram form components of the apparatus.

Referring to FIGS. 1 and 2, the apparatus 10 has mounted to or in the housing 30, a bank 38 of capacitors 40, a charging circuit 42, a measurement circuit 44, a processor 46, a memory unit 48, an array 50 of LEDs (light-emitting diodes), a display 52, a communication module 54, a battery 56 and an input module 60. The capacitors in the capacitor bank 40 are connected to antenna terminals 64 and 66. The antenna 12 is also connected to these terminals. The input module 60 is connected to input terminals 70 and 72. The processor 46 is connected to a switch 74 which is accessible on the surface 36 of the housing. One or more contacts 76 are connectible, as required, to a plurality of sensors 78. The sensors are chosen according to requirement and typically are used to monitor parameters such as temperature, humidity, and time of operation of the apparatus, and to obtain an indication of geographical position of the apparatus through the use of a GPS.

If the apparatus is to be used with different antennas which have the same inductance values then it is conceivable that the capacitors 40 can be chosen to have a set value. However to allow for use of the apparatus with antennas which have different inductance values the bank 38 includes a plurality of capacitor modules 40A, 40B . . . 40N. The capacitance values of the capacitors in each module are chosen so that substantially any desired capacitance value can be provided by selectively choosing the appropriate modules.

A switching circuit 80 is used together with the capacitor bank 38. As is explained hereinafter the switching circuit 80 can be used manually by means of an operator or automatically via signals from the processor 46.

The apparatus 10 is used in the manner which has been described in the preamble to this specification. Thus the antenna 12 is deployed to enclose the area 16 which comprises a blast site. The apparatus 10 is positioned at a location which is relatively safe and secure and protected against blasting effects. The antenna 12 is then connected to the terminals 64 and 66. Thereafter the transmitter arrangement 14 is connected to the terminals 70 and 72 by means of a suitable cable 82.

By activating the switch 74 a testing exercise is implemented. During this process the measurement circuit 44 in the apparatus is isolated from the high voltage which is supplied from the transmitter arrangement 14 to the apparatus 10 via the cable 82.

The measuring circuit 44 measures the inductance and capacitance of the antenna 12. These are known values and data relating thereto is stored in the memory unit 48. Any meaningful deviation from the known values is indicative that the integrity of the connections made to the terminals 64 and 66 is suspect. The circuit 44 also measures the integrity of the connections made to the terminals 70 and 72. This is done in an appropriate way for example by measuring continuity in conductive lines on each side of the terminals 70, 72—continuity in a line or terminal is readily ascertained by means of one or more resistance value measurements.

The measuring circuit 44 can also be used to measure the resistance of the antenna 12 which is connected to the terminals 64 and 66. The resistance value of the loop antenna is generally known from previous measurements. That resistance value does not change unless some extraneous event has occurred. For example, the wires in the antenna may be damaged or may be affected by high temperature, moisture or humidity. The resistance measurement taken by the measuring circuit allows for these deviations to be handled. The resistance measurement can be taken directly from the antenna coil 12, as is indicated by a line AC or upstream of the contacts 64 and 66 as is indicated by means of a line marked UC. The latter measurement allows any change in the measured resistance, due to effects of the connections, to be detected.

The measurement data is collected by the processor 46 and stored in the memory unit 48. An output of the data is available on the display 52. In one embodiment the array 50 of LEDs is fashioned so that if all the connections are in order a green LED is illuminated. If something is amiss a red LED is illuminated—this is a signal to an operator that remedial action must be taken.

In operation of the apparatus 10 the input module 60 conditions an electrical supply from the blast control unit 22, which draws power from the power source 24. The charging circuit 42 charges the capacitors 40 in the bank 38 to operating voltages. These voltages are sufficiently high to drive the antenna 12 so that it has a suitable range of performance. The battery 56 is powered and recharged by energy drawn from the input cable 82, and is used to power the processor 46, the array 50 of LEDs, and the display 52. To conserve power the LEDs and display are only energised when the switch 74 is operated.

The inductance measurement is additionally an indicator of good deployment of the antenna 12, for the inductance measurement is dependent on the size of the area 16 enclosed by the antenna. If the antenna is not satisfactorily deployed, for example if it is folded, then the inductance signal would be meaningfully affected.

The apparatus 10 has the capability, via the sensors 78, of collecting data (environmental or from any other cause) relating to factors which could have an influence on a blasting process. This data is stored in the memory unit.

The communication module 54 includes a number of ports which enable information in the memory module 48 to be downloaded. For example a near field communication (NFC)-enabled tagger can retrieve data via a port 54A (FIG. 1), and Wi-fi and USB connections can be made via ports 54B and 54C respectively.

In one variation of the aforementioned process the inductance of the loop antenna 12 is measured by the circuit 44. The processor 46, executing a program which is based on the use of known techniques, then calculates a capacitance value which should be connected to the antenna to achieve optimum performance. The display 52 is used to provide a visual indication of the capacitance value which is to be connected to the loop antenna. An operator can then choose from the modules 40A to 40N and via the switching circuit 80 ensure that capacitors of the correct capacitance values are connected to the loop antenna.

It is possible to automate the aforementioned process by suitably designing the switching circuit 80. In this instance the desired capacitance values are calculated, in the manner described, by the processor 46 and the switching circuit 80, in response to signals from the processor 46 then is actuated to connect a suitable selection of the modules 40A to 40N to the antenna coil.

In another approach the processor 46 causes the switching circuit 80 to sweep through various possible connections of groups of the capacitors so that the capacitance value connected to the loop antenna is gradually changed. For each stepped value the degree of tuning is determined by the measuring circuit and when an optimum value is reached the operator is notified via a suitable signal on the display 52.

FIG. 2 also illustrates that power to the apparatus may be derived from a mains source 84. The energy from this source is used to charge the capacitors and to charge the battery 56. If the battery 56 is of adequate size then the battery, recharged as appropriate, can be used for the charging of the capacitors.

The invention claimed is:

1. Apparatus for use in a wireless detonator system, the apparatus including a housing and, mounted in or to the housing, a bank of capacitors, antenna terminals on the capacitors for connection to an antenna, input terminals for connection at least to a transmitter arrangement, a charging circuit for charging the capacitors, a measurement circuit configured to measure the integrity of connections of the antenna made to the antenna terminals and to measure the integrity of connections of the transmitter arrangement made to the input terminals, and an output device, responsive to the measurement circuit, to provide an output signal which is dependent on the integrity measurements.

2. Apparatus according to claim 1 wherein the capacitor bank comprises a plurality of capacitors of different capacitance values, or modules of capacitors with different capacitance values.

3. Apparatus according to claim 1 which includes an onboard power source for powering at least the output device.

4. Apparatus according to claim 1 wherein the measurement circuit is configured to measure the resistance of the antenna.

5. Apparatus according to claim 1 which includes a memory unit in which details of measurements made by the measuring circuit are stored.

6. Apparatus according to claim 1 wherein the housing includes a base in or to which the capacitor bank, the charging circuit, the measurement circuit, the memory unit, the processor and the output device are mounted, with the output device being visible on an outer surface of the base.

7. A method of establishing a wireless detonator blasting system which includes the steps of deploying detonators at a blast site, surrounding the blast site with a loop antenna, measuring the resistance, inductance and capacitance of the antenna, comparing the measured resistance, inductance and capacitance values to known values stored in a memory thereby to obtain an assessment of the integrity of connections made to the antenna, using a switching circuit to connect sets of capacitors, of different capacitance values, automatically in succession to the loop antenna and, for each set of capacitors connected to the loop antenna, obtaining a measurement of the degree of inductive/capacitive turning of the antenna, in response to such measurement, selecting a set of capacitors for operative connection to the loop antenna, measuring the integrity of all connections to the loop antenna and, if the connections are acceptable charging the capacitors to an operating voltage to commence a blasting process.

* * * * *